United States Patent [19]

Komatsu et al.

[11] 3,940,728

[45] Feb. 24, 1976

[54] ALLOY FOR A HIGH TEMPERATURE FUSE

[75] Inventors: Noboru Komatsu; Mikio Obayashi; Minoru Doi, all of Nagoya; Nobuyoshi Ota, Kariya; Yoshio Iwai, Nagoya, all of Japan

[73] Assignees: Kabushiki Kaisha Toyota Chuo Kenkyusho; Nippondenso Co., Ltd., both of Japan

[22] Filed: Aug. 3, 1973

[21] Appl. No.: 385,429

[30] Foreign Application Priority Data

Aug. 8, 1972 Japan ..... 47-79784

[52] U.S. Cl. ..... 337/290; 337/295

[51] Int. Cl.² ..... H01H 85/04

[58] Field of Search ..... 75/162, 122; 337/290, 295, 337/296

[56] References Cited

UNITED STATES PATENTS

| | | | |
|---|---|---|---|
| 2,703,352 | 3/1955 | Kozacka | 337/290 X |
| 3,009,040 | 11/1961 | Bernstein | 337/290 |
| 3,662,310 | 5/1972 | Nielsen | 337/290 |

*Primary Examiner*—L. T. Hix
*Assistant Examiner*—Fred E. Bell
*Attorney, Agent, or Firm*—Hill, Gross, Simpson, Van Santen, Steadman, Chiara & Simpson

[57] ABSTRACT

An alloy for use as a fuse element in a high temperature fuse characterized by having a high resistance to corrosion and a melting point at a fixed temperature within a range of 1000° to 1100°C. The alloy consists of copper containing 10–14% aluminum and 0–2.5% of a second constituent which second constituent consists of one or more metals selected from a group consisting of nickel, manganese and iron. The alloy also has desirable hardness and good workability to enable fabrication of the alloy into a fused element.

4 Claims, 9 Drawing Figures

Fig. 2

ALLOY FOR A HIGH TEMPERATURE FUSE

BACKGROUND OF THE INVENTION

1. Field of the Invention

The present invention relates to an alloy for a fuse element of a high temperature fuse, the high temperature fuse and a method of indicating a high temperature condition.

2. Prior Art

In devices which operate in an atmosphere of a high temperature such as electric furnaces, after burners and manifold reactors for automobiles, overheating of the device by exceeding an upper temperature limited of approximately 1100°C can cause structural damage such as oxidation of wall surfaces or even the melting of various parts of the device. To indicate when the device reaches an excessive temperature which may result in overheating, it has been suggested to utilize an indicating device in an electrical circuit which has a thermo fuse or switch. When the fuse element of the fuse melts or breaks due to beginning to melt, the indicating device such as a lamp is energized to indicate that a predetermined temperature has been reached. By utilizing the signal provided by the indicating device, corrective action can be taken to prevent any detrimental effects on the equipment or device due to overheating. Since pure copper has a melting point of 1083°C, it has been suggested to use copper for a fuse element in a fuse to indicate reaching a temperature in a range of 1000° to 1100°C. While pure copper has the desirable melting point at a fixed temperature, it has a very low resistance to oxidation when exposed to an atmosphere at high temperatures. Thus, pure copper is unsatisfactory for use as a fuse element under these conditions.

Since pure copper has been found unsatisfactory as a fuse element, alloys based on nickel, iron, cobalt and the like which alloys have a high oxidation resistance and melt within a temperature range of 1000° to 1100°C have been suggested. However, due to the constituents used in these alloys, the particular alloys do not melt at a fixed temperature or in other words the alloys will not change from a solid phase to a liquid phase or molten state at a fixed temperature in the manner that pure copper does.

As one of the particular alloys is heated through a range of temperatures, a portion of the alloy will begin to be changed to a liquid phase at a given temperature with the amount of liquid phase increasing as the temperature of the alloy is raised above the given temperature until the alloy reaches a temperature at which the alloy is completely molten. The range between the lowest temperature at which the first liquid phase appears and the temperature at which all of the alloy is in a molten state is hereafter referred to as the range of melting temperatures for the alloy and the range of melting temperatures becomes wider as the amount of alloying constituen[illegible] alloy is increased. The strength of these a[illegible]ys decreases as the volume of liquid phase therein increases over a wide range of melting temperatures so that the strength of these alloys is gradually decreased over a wide range of melting temperatures. Since the melting and breaking temperature of these proposed alloys is not fixed in a narrow range of temperatures, they are unsuitable for use in a fuse element. For satisfactory use, the alloy or material used in the fuse element must have a good oxidation resistance and have a melting and breaking temperature at a fixed temperature which is defined as a temperature in a very narrow range of temperatures such as within a range of 10°.

SUMMARY OF THE INVENTION

The present invention is directed to an alloy for a fuse element, a fuse utilizing the fuse element and a method of indicating an elevated temperature. The alloy has a very narrow range of melting temperatures which range occurs within a range of 1000° to 1100°C and the alloy has a very good resistance to corrosion at elevated temperatures and thus has a very good oxidation resistance. To accomplish these features, the fuse element is formed from one of two groups of copper alloys with the alloys of the first group consisting of 10–14% aluminum with the balance being copper and the alloys of the second group consisting of 10–14% aluminum, up to 2.5% of a second constituent with the second constituent consisting of one or more metals selected from a group consisting of iron, nickel and manganese, and the remainder of the alloy comprising copper.

DESCRIPTION OF THE PREFERRED EMBODIMENTS

Figure 1A:
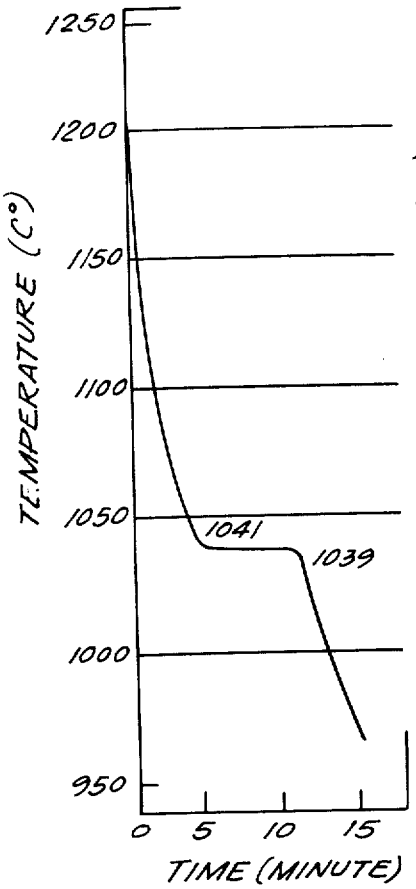
FIGS. 1*a*, 1*b* and 1*c* are graphs of the thermal analysis of three different alloys for a fuse element of the present invention.

The principles of the present invention are directed to providing a metal alloy for use as a fuse element and a fuse device which can be utilized for detecting when a prescribed or given abnormally high temperature is reached. The metal alloy exhibits a melting point or melting temperature in a very narrow range of temperatures which range is within a range of 1000° to 1100°C, and the alloy exhibits a high resistance to corrosion along with very good workability to enable forming the metal alloy into the fuse element.

The metal alloy consists of 10–14% (weight per cent) of aluminum with the balance being copper and displays the above-mentioned properties of a very narrow range for the melting temperature with the temperature range being in a range of 1000 to 1100°C and also a very good oxidation resistance at high temperature and thus a high resistance to corrosion. In addition, the copper aluminum alloy has the desired hardness and workability to enable fabrication of a fuse element. The copper aluminum alloy may include a second constituent of up to 2.5% (weight per cent). The second constituent can be formed of one or more metals selected from a group consisting of iron, manganese, and nickel. The alloy with the second constituent provides a good oxidation resistance at high temperature. However, if the second constituent exceeds 2.5%, the range of the melting temperature becomes wider than the range of the alloys that do not contain the second constituent and an alloy containing more than 2.5% of the second constituent is unsuitable for making a fuse element.

Six samples of copper alloys of the present invention were compared with six samples of other materials which include pure copper and five other copper-aluminum alloys. These comparisons include the range of melting temperature as detected by means of a thermal analysis which is the measuring of the solidifcation temperature of an alloy with a thermocouple during a gradual cooling process of a molten metal. The comparison also includes a comparison of oxidation resistance by measuring the weight gain of the sample which was maintained at 950°C for a period of 100 hours. Finally, the comparison in the following table includes a comparison of hardness which is one of the standards of workability and which hardness was measured by means of a Vickers hardness test determined with JIS (Japanese Industrial Standard) Z 22 44 (1961). The results of the various tests are given in the following table with samples 1 through 6 being alloys of the present invention, samples 7 through 11 being other copper alloys and sample 12 being pure copper.

120 mg/cm². The copper-aluminum alloys which included a small amount of nickel, manganese or iron (samples, 4, 5 and 6) had especially good oxidation resistance.

Figure 2:
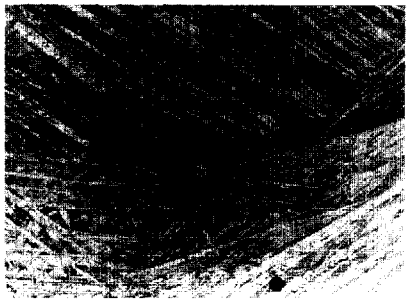
FIG. 2 is a photomicrograph of an example of an alloy of the present invention.

If the hardness of the alloy is greater or more than Hv 400, the alloy has poor workability characteristics, is brittle, and thus, is not practical for use as a fuse element. The hardness of samples 1 through 6 is approximately 350 or less, and therefore, each of these alloys is usable for making fuse elements. Also, the alloys of samples 1 through 6 do not become hard and brittle even if the alloys are rapidly cooled after being heated at 950°C for a period of 4 hours. As shown in FIG. 2, the microstructure of sample 2 (Cu-12% Al) in the cast state indicates a homogeneous single phase structure. The sample, which was hardened after being heated to 950°C, indicates entirely the same microstructure as that of FIG. 2. Thus, the alloy apparently has a single phase $\beta$ structure at a high temperature. This test also shows that the material of the alloy is scarcely changed while subjected to heating and cooling during use as a fuse element.

The table

| Sample No. | Chemical element (%) | | | The range of the melting temperature (°C) | | Oxidation Resistance | Hardness Hv (5kg) | | | |
|---|---|---|---|---|---|---|---|---|---|---|
| | | | | | | Oxidized weight gain in the air at 950°C for 100 hrs. (mg/cm²) | Cast state | After heated at 950°C for 4 hrs. | | |
| | Cu | Al | Others | beginning of solidification | ending of solidification | | | Water cooled | Air cooled | Furnace cooled |
| 1 | bal. | 10.0 | — | 1041 | 1039 | 1.21 | 134.8 | 264 | 122 | 117 |
| 2 | bal. | 12.0 | — | 1064 | 1062 | 1.08 | 166.4 | 173 | 185 | 346 |
| 3 | bal. | 14.0 | — | 1049 | 1048 | 0.89 | 352.6 | 273 | 339 | 355 |
| 4 | bal. | 12.0 | Ni 2.0 | 1049 | 1046 | 0.89 | 212 | 186 | 256 | 302 |
| 5 | bal. | 12.0 | Mn 2.0 | 1036 | 1031 | 0.44 | 195 | 197 | 227 | 213 |
| 6 | bal. | 12.0 | Fe 2.0 | 1051 | 1046 | 0.56 | 226 | 223 | 213 | 254 |
| 7 | bal. | 3.0 | — | 1082 | 1075 | 142 | 62.7 | — | — | — |
| 8 | bal. | 6.0 | — | 1074 | 1071 | 173 | 63.3 | — | — | — |
| 9 | bal. | 8.0 | — | 1035 | 1032 | 0.14 | 71.3 | 82.6 | 78.6 | 82.7 |
| 10 | bal. | 16.0 | — | 1041 | 1034 | 0.72 | 467.2 | 455 | 451 | 457 |
| 11 | bal. | 18.0 | — | 1022 | 1012 | — | 529.2 | — | — | — |
| 12 | 100 | — | — | 1083 | 1083 | 120 | — | — | — | — |

Figure 1B:
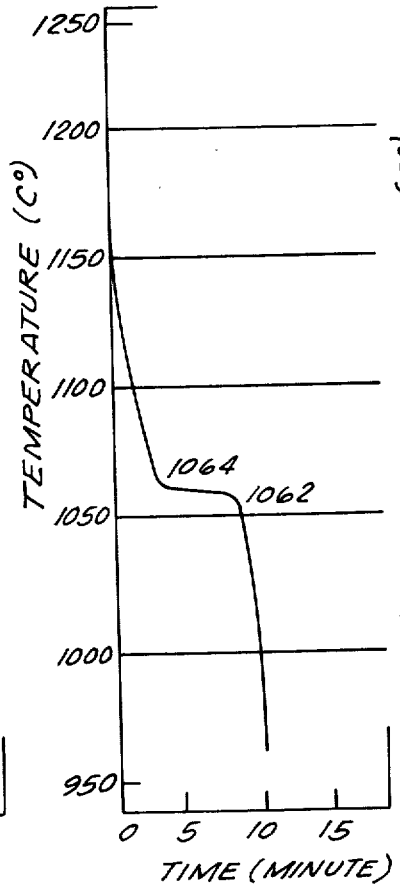
Figure 1C:
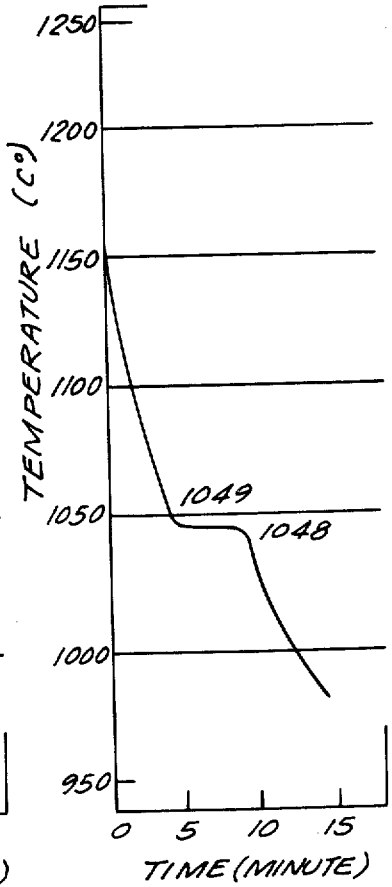

FIGS. 1*a*, 1*b* and 1*c* are graphic illustrations of the thermal analysis for samples 1, 2 and 3, respectively. As illustrated, temperatures (°C) is plotted along the axis of the ordinate while time (minutes) is plotted along the axis of the abscissas.

A thermal analysis of sample 1 (Cu-10% Al) is illustrated in FIG. 1*a*. During cooling of the molten alloy, the solidification of the alloy begins at 1041°C and the alloy is entirely solidified at 1039°C. Thus, FIG. 1*a* shows that by heating sample 1 rapidly, the alloy will begin to melt at 1039°C and be completely melted upon reaching the temperature of 1041°C. Therefore, the range of the melting temperature is extremely narrow.

A thermal analysis of sample 2 (Cu-12% Al) is illustrated in FIG. 1*b*. FIG. 1*c* illustrates a thermal analysis for sample 3 (Cu-14% Al).

From the thermal analysis of samples 1 to 11, the range of the melting temperature is very narrow and is less than 10°C. The sample 12, which is pure copper, becomes molten at a set temperature of 1083°C. The range of melting temperatures of samples 1 through 6, which are examples of the alloy of the present invention and contain 10–14% by weight of aluminum, is less than 5°C.

The oxidized weight gain of samples 1 through 6 is 1.21 mg/cm² or less and this value is much smaller than the weight gain of pure copper (sample 12) which was From the test results illustrated in the table, it would appear that sample 9 (Cu-8% Al) has a range of melting temperature of 3°C, a hardness of less than Hv 100, and an oxidation weight gain of 0.14 mg/cm². However, when the sample is subjected to repeated heating and cooling, the oxide film, which formed on its surface, is easily peeled off. Thus, a fuse element of the alloy would not endure the repeated heating and cooling which would occur when the fuse element was utilized in a thermo or high temperature fuse or switch. It is also noted that sample 10 (Cu-16% Al) has a hardness that is over Hv 400. Thus, the alloy of sample 10 is brittle, does not display the desired workability, and would not be useful for the purposes of the present invention.

From the results contained in the above table, the range of melting temperatures of the copper alloys including 10–14% aluminum (samples 1 through 6) is very narrow and is 5°C or less. These alloys become molten nearly at a fixed temperature in a manner similar to pure copper. The oxidation resistance and thus the corrosion resistance of the alloys of samples 1 through 6 is good and they display a superior workability so that plates and rods of these alloys can be easily produced by means of hot working. Furthermore, when heated to a temperature below the melting temperature of the alloy, these alloys experience very little structural changes. Therefore, since the alloys of samples 1 through 6 become molten at almost a fixed temperature, it is recognized that the alloys are suitable for a metal fused element. Furthermore, the copper alloys which contain the 2% (wt) nickel, 2% (wt) manganese, or 2% (wt) iron in addition to the 10–14% (wt) aluminum display an especially good oxidation resistance at high temperatures.

Figure 3:
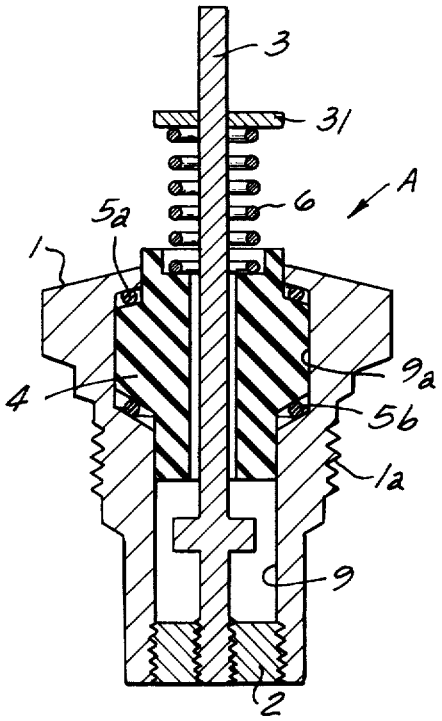
FIG. 3 is one embodiment of a thermo fuse or switch utilizing a fuse element of the alloy of the present invention.

The alloy of the present invention is particularly useful as a fuse element in a thermo fuse or switch A such as illustrated in FIG. 3. The thermo fuse includes a tubular housing 1, a fuse element 2, and a shaft 3. The housing 1 and shaft 3 are made of an electrically conducting material and form a pair of terminals which are interconnected by the fuse element 2. As illustrated, the housing 1 has a bore 9 with internal threads for threadably receiving the fuse element 2. The shaft 3 is threadably received in a threaded opening in the fuse element 2 and is disposed in the bore 9 of the housing 1. To insulate the housing 1 from the shaft 3, an insulator 4 is received in an enlarged portion 9*a* of the bore 9 of the housing 1 and is spaced from the internal shoulders formed by the portion 9*a* by ring-type packings 5*a* and 5*b*. The shaft 3 has a disc-type projection or part 31 received on one end which part 31 acts as an abutment for a compression spring 6 disposed between the part 31 and a surface of the insulator 4. Thus, when the fuse element 2 of the copper alloy of the present invention melts at a fixed temperature, the spring 6 urges the shaft 3 out of engagement or electrical contact with the fuse element 2 to break the electrical connection between the housing 1 and the shaft 3.

The fuse is utilized by being mounted on a wall of the device in which the temperature is to be detected. As illustrated, the housing 1 has external threads 1*a* which are threadably received in a threaded aperture in the housing with the end having the fuse element 2 disposed in the atmosphere whose temperature is to be detected.

Figure 4:
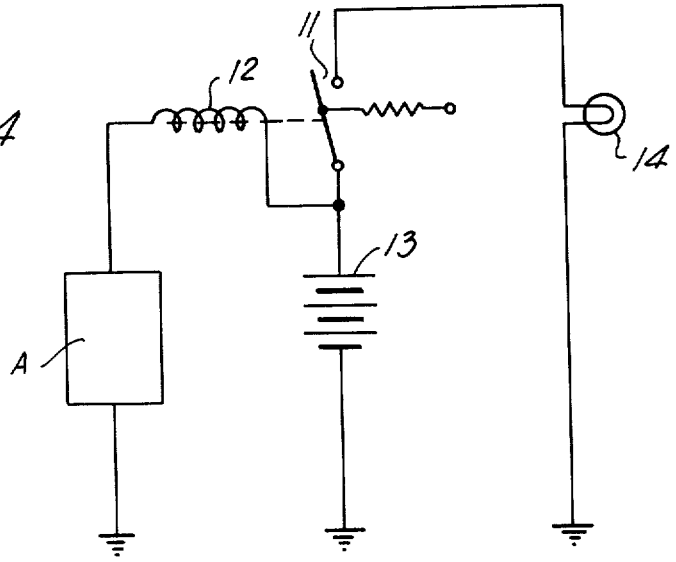
FIG. 4 is a schematic circuit diagram for the fuse and indicating device.

In order to detect the melting of the fuse element 2 and the breaking of the electrical circuit, the fuse is placed in a detecting circuit such as illustrated in FIG. 4. The fuse A is diagrammatically illustrated as a box A, with one of the two terminals formed by the housing 1 and the shaft 3 connected to ground and the other terminal, preferably the shaft 3, connected in series with a coil 12 and an electric energy source such as a battery 13 which battery is in turn connected to ground. The battery 13 is also connected in series through a movable contact switch 11 to an indicating device such as the lamp 14 which in turn is connected to ground.

When the terminal formed by the shaft 3 is electrically connected to the housing 1 by the fuse element 2, the flow of current through the coil 12 creates a magnetic field which acts on an armature of the movable contact to hold the contact 11 in the open position. When the temperature reaches the fixed value to cause melting of the fuse element 2, electrical connections between the terminals of the fuse A is broken to deenergize the coil 12 which allows the contacts 11 to close to energize the indicating device such as by lighting the lamp 14. The electrical circuit only applies approximately 200 mA through the fuse element 2 and such a current is sufficiently small that it does not generate any heat due to electrical resistance of the fuse element.

Tests were conducted using the alloy of the present invention for the fuse element 2. In these tests, three different alloys were utilized. Alloy (A) was a copper alloy containing 10% aluminum which corresponds to sample 1 in the hereinabove described table. Alloy (B) was a copper alloy containing 12% aluminum and corresponds to sample 2. Alloy (C) is a copper alloy containing 12% aluminum and 2% iron which corresponds to sample 6 in the above table. The tests were run with five samples of each of the three alloys. By measuring the temperature of the alloy by means of alumelchromel thermocouple at the time that the lamp became lighted, the following results were determined. With the alloy (A) the lamp was turned on when the temperature was in the range of 1040°–1041°C; with the alloy (B) the lamp was turned on at a temperature range of 1063°–1064°C; and with an alloy (C) the lamp was turned on at a temperature range of 1048°–1051°C. Thus, if the atmosphere of the device is in danger of overheating when the temperature exceeds a given temperature, a fuse using any one of the above alloys will provide a warning when the temperature approaches the critical temperature and will enable corrective action to be taken to avert a further increase of the temperature.

Figure 5:
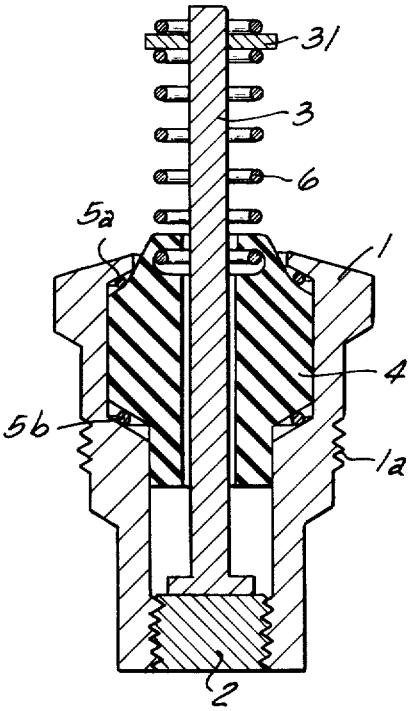
FIGS. 5–7 are three other embodiments of thermo fuses or switches using a fuse element of the alloy of the present invention.

In the embodiment of the fuse of FIG. 3, when the element 2 becomes molten, the spring 6 forces the shaft 3 upwards to break the electrical connection between the housing 1 and the shaft 3. However, the structure of the fuse may be modified so that the shaft is pushed outwards or downward by means of the spring force to break the electrical connection. A modified thermo fuse or switch is illustrated in FIG. 5 and the parts corresponding to those in FIG. 3 are shown with the same element numbers. In the fuse device of FIG. 5, a tension spring 6 biases the shaft 3 onto the fuse element 2. When the fuse element 2 is heated to its melting point, the shaft 3 which is pushing down on the element 2, will break the element and therefore break the electrical connection between the housing 1 and the shaft 3.

Figure 6:
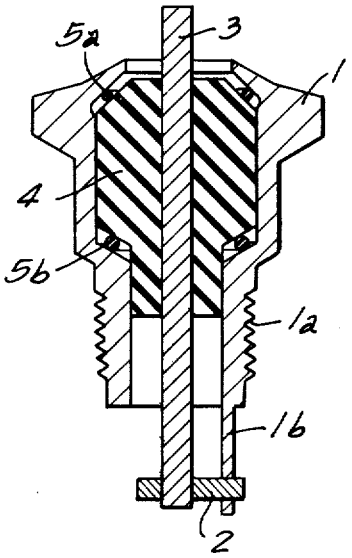

In FIG. 6 another embodiment of a thermo fuse utilizing fuse element 2 of the alloy of the present invention is illustrated. In this embodiment, the housing 1 is provided with a projection 1*b* and the shaft 3 is fixedly mounted in the insulator 4 which insulator is in turn held in the housing 1, as in the previous embodiments. The fuse element 2 electrically connects the shaft 3 to the housing 1 through the projection 1*b*. The fuse element 2, which is the only part of the fuse device that is projected into the atmosphere whose temperature is to be detected, is made very thin so that its heat capacity is small. Therefore, the response time is extremely short and the element 2 will melt rapidly to break contact between the shaft 3 and the housing 1. In this device, the breaking of the connection is accomplished without requiring any spring force as in the previous two embodiments.

Figure 7:
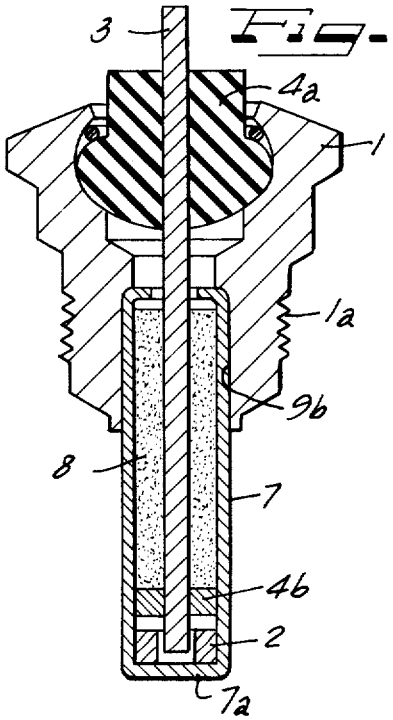

A fourth embodiment of a fuse device is illustrated in FIG. 7. In this embodiment, an annular fuse element 2 such as a cylindrical ring or part is inserted in the tube 7 which has an inner diameter substantially equal to the outer diameter of the fuse element 2 and is in contact with a bottom plate 7*a* of the tube 7. The tube 7 is coaxially received in the passageway 9*b* of the housing 1. The shaft 3 is supported in the housing by an insulator 4*a* and in the tube 7 by an insulator 4*b* with an insulation powder 8 packed between the shaft 3 and the inner wall of the tube 7. As illustrated, the annular fuse element 2 is in spaced relationship to the end of the shaft 3 so that no electrical contact is provided. During use, when the alloy forming the fuse element 2 is heated to the melting point, the element 2 melts to make an electrical connection between the shaft 3 and the tube 7 which is electrically connected to housing 1. The embodiment of the fuse illustrated in FIG. 7 can be used in series with a lamp without requiring the electromagnetic coil and the electro-magnetically operated movable contacts 11 of the previously described circuit diagram of FIG. 4.

The thermo fuse or switch has a practical employment for example in a safety device for a manifold reactor in which the exhaust gas from the exhaust manifold of an engine is collected and the secondary gas is supplied to the exhaust gas so that the unburnt elements in the exhaust gas can be burned. The manifold reactor will reach a high temperature of more than 1000°C when it is operating for a long period of time. Because the atmosphere is an oxidizing one, the inner surfaces of the walls of the container, which walls are made of steel plate, are in contact with the gases and will oxidize when the temperature exceeds 1100°C. By providing a detecting device including a thermo fuse with a fuse element in the chamber of the manifold reactor, the thermo fuse will detect when the temperature of the gases approach the critical temperature. If the engine is stopped or the velocity of the vehicle is lower at the time of detecting the critical temperature, the damage caused by abnormally high temperature in the manifold reactor can be prevented.

Although various minor modifications may be suggested by those versed in the art, it should be understood that we wish to employ within the scope of the patent warranted hereon all such modifications as reasonably and properly come within the scope of our contribution to the art.

We claim:

1. In a fuse having a pair of electrical terminals arranged in spaced relationship and insulated from each other, and a metal fuse element disposed adjacent the pair of terminals for forming the electrical connection therebetween, the improvement comprising the metal fuse element being of a metal alloy having a higher resistance to corrosion at elevated temperatures and a melting point at a fixed temperature within a range of 1000° to 1100°C, said alloy consisting of 10–14% aluminum, a second constituent in a range of 0–2.5% and the balance being copper, said second constituent consisting of at least one metal selected from a group consisting of nickel, manganese and iron.

2. In a fuse according to claim 1, wherein the second constituent is present in an amount of 2% and is iron.

3. In a fuse according to claim 1, wherein the second constituent is present in the amount of 2% and is manganese.

4. In a fuse according to claim 1, wherein the second constituent is present in an amount of 2% and is nickel.

* * * * *